US009771175B2

(12) United States Patent
Giuliani et al.

(10) Patent No.: US 9,771,175 B2
(45) Date of Patent: Sep. 26, 2017

(54) LABELLING UNIT FOR APPLYING A LABEL ONTO AN ARTICLE

(71) Applicant: Sidel S.p.A. con SOCIO UNICO, Parma (IT)

(72) Inventors: Mattia Giuliani, Parma (IT); Francesco Laino, Parma (IT)

(73) Assignee: SIDEL S.P.A. CON SOCIO UNICO, Parma (IT)

( * ) Notice: Subject to any disclaimer, the term of this patent is extended or adjusted under 35 U.S.C. 154(b) by 482 days.

(21) Appl. No.: 14/574,767

(22) Filed: Dec. 18, 2014

(65) Prior Publication Data

US 2015/0175290 A1 Jun. 25, 2015

(30) Foreign Application Priority Data

Dec. 20, 2013 (EP) ..... 13199203

(51) Int. Cl.
*B65C 3/00* (2006.01)
*B65C 3/06* (2006.01)

(52) U.S. Cl.
CPC ..... *B65C 3/065* (2013.01)

(58) Field of Classification Search
CPC ..... B65C 3/065
See application file for complete search history.

(56) References Cited

U.S. PATENT DOCUMENTS

2013/0008612 A1* 1/2013 Pace ..... B29C 63/426 156/538
2013/0153150 A1* 6/2013 Pace ..... B65C 3/065 156/361

FOREIGN PATENT DOCUMENTS

EP 2567901 A1 3/2013
WO WO 2011/104732 9/2011
WO WO 2011/117895 9/2011

OTHER PUBLICATIONS

European Search Report in EP 13199203, mailed Apr. 25, 2014 (3 pages).

* cited by examiner

*Primary Examiner* — Jeff Aftergut
(74) *Attorney, Agent, or Firm* — Finnegan, Henderson, Farabow, Garrett & Dunner, L.L.P.

(57) ABSTRACT

A labelling unit comprises: support means, a receiving member, adapted to carry an article on a top end and to receive a label on a lateral surface, and supported by the support means in a translating and rotating manner with respect to a given axis, driving means including a driving shaft carried by the support means in a rotating manner about the axis and engaging an axial hole of the receiving member, and releasable fastening means to connect the driving shaft to the receiving member in a predetermined axial position. The releasable fastening means comprise a spline element movable transversely to the axis between a retaining position, in which the spline element locks axially the receiving member onto the driving shaft, and a release position, in which the spline element allows extraction of the receiving member from the driving shaft and the support means along the axis.

10 Claims, 8 Drawing Sheets

LABELLING UNIT FOR APPLYING A LABEL ONTO AN ARTICLE

CROSS-REFERENCE RELATED APPLICATIONS

This application claims the benefit of priority of European Patent Application No. 13199203.4, filed Dec. 20, 2013, which is incorporated herein by reference.

The present invention relates to a labelling unit for applying a label, in particular made of heat-shrinking film, onto an article, such as a bottle or a generic container, which the following description will refer to, although this is in no way intended to limit the scope of protection as defined by the accompanying claims.

BACKGROUND OF THE INVENTION

As it is generally known, labelling machines are used to apply labels to containers or articles of all sort. Typically used with beverage bottles or vessels are tubular labels (commonly called "sleeve labels"), which are obtained by:

cutting the web unwound from a supply roll into a plurality of rectangular or square labels;

bending each label in a cylindrical configuration such that the opposite vertical edges overlap one another; and welding the overlapped edges of each cylindrical label.

A particular type of labelling machine is known which serves to bend and weld labels in a tubular configuration and to produce insertion of containers into the so formed tubular labels. This kind of machine basically comprises a carousel rotating about a vertical axis to define a circular path, along which it receives a succession of unlabelled containers and, then, a succession of rectangular or square labels from respective input wheels, produces application of the labels in a tubular configuration onto the respective containers and releases the labelled containers to an output wheel.

More specifically, the carousel comprises a plurality of labelling units which are equally spaced about the rotation axis, are mounted along a peripheral edge of the carousel and are moved by the latter along the above-mentioned circular path.

Each labelling unit comprises a bottom supporting assembly adapted to support the bottom wall of a relative container and an upper retainer adapted to cooperate with the top portion of such container to hold it in a vertical position during the rotation of the carousel about the vertical axis.

Each supporting assembly comprises a vertical hollow supporting mount, secured to a horizontal plane of a rotary frame of the carousel, and a cylindrical receiving member, engaging the supporting mount in sliding and rotating manner with respect to its axis, and adapted to carry a relative container on its top surface and a relative label on its lateral surface.

Each receiving member can be displaced between a raised position and a fully retracted position within the hollow body of the respective supporting mount.

In the raised position, each receiving member protrudes from a top platform of the respective supporting mount and is adapted to receive a label on its lateral surface from the label input wheel; in particular the label is wrapped around the receiving member such that the opposite vertical edges of the label overlap one another.

In order to produce this complete wrapping, the receiving member is rotated about its axis during the transfer of the label from the label input wheel.

In the fully retracted position, which is reached at the container input and output wheels, the top surface of each receiving member is flush with the upper surface of the top platform of the supporting mount so that containers are transferred onto and from the carousel along the same transfer plane.

After the welding of the overlapped edges of a tubular label, the displacement of the respective receiving member from the raised position to the fully retracted position produces the insertion of the container inside the label, making the so obtained container ready to be transferred to the output wheel.

Each label is retained on the lateral surface of the respective receiving member by suction; in particular, at least a region of the lateral surface of each receiving member is provided with a plurality of holes in turn connected to a pneumatic suction device.

In order to be rotated about its axis, each receiving member is secured to a driving shaft by one or more screws; in particular, each driving shaft is part of a respective actuator assembly carried by the rotary frame of the carousel and extending through a central hole of the respective receiving member.

It is evident from the above that any change of the container bottom surface or diameter entails a replacement of ail receiving members, with consequent long dismantlement and reassemble times as well as high costs.

As a matter of fact, the operator has to act on a really large number of screws, which have to be first unscrewed to allow disassembly of the receiving members from the respective driving shafts and then retightened on the new receiving members.

SUMMARY OF THE INVENTION

It is an object of the present invention to provide a labelling unit, which allows to overcome the above drawback in a straightforward and low-cost manner.

This object is achieved by a labelling unit as claimed in claim 1.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
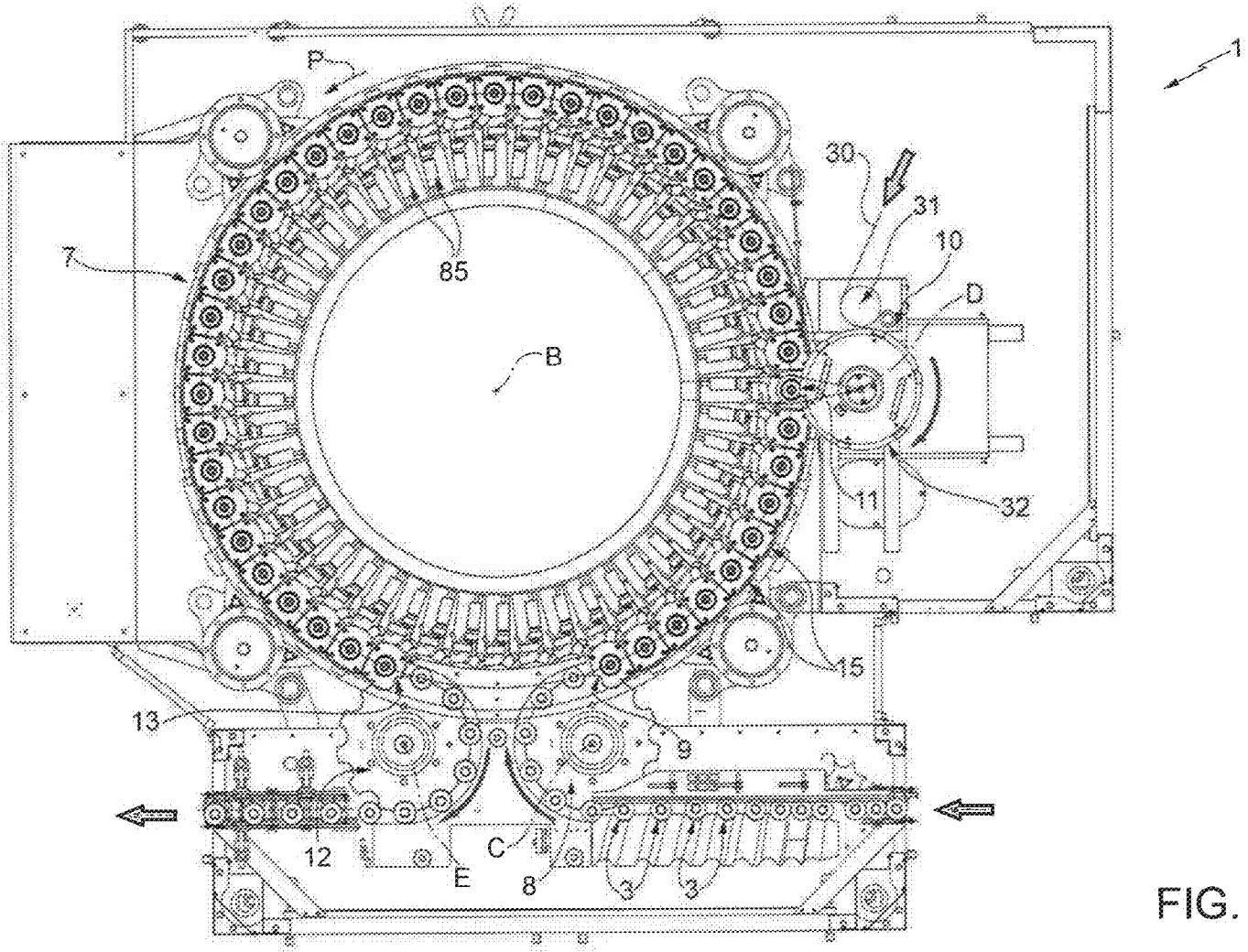
FIG. 1 shows a schematic plan view, with parts removed for clarity, of a labelling machine provided with a plurality of labelling units in accordance with the teachings of the present invention.
Figure 2:
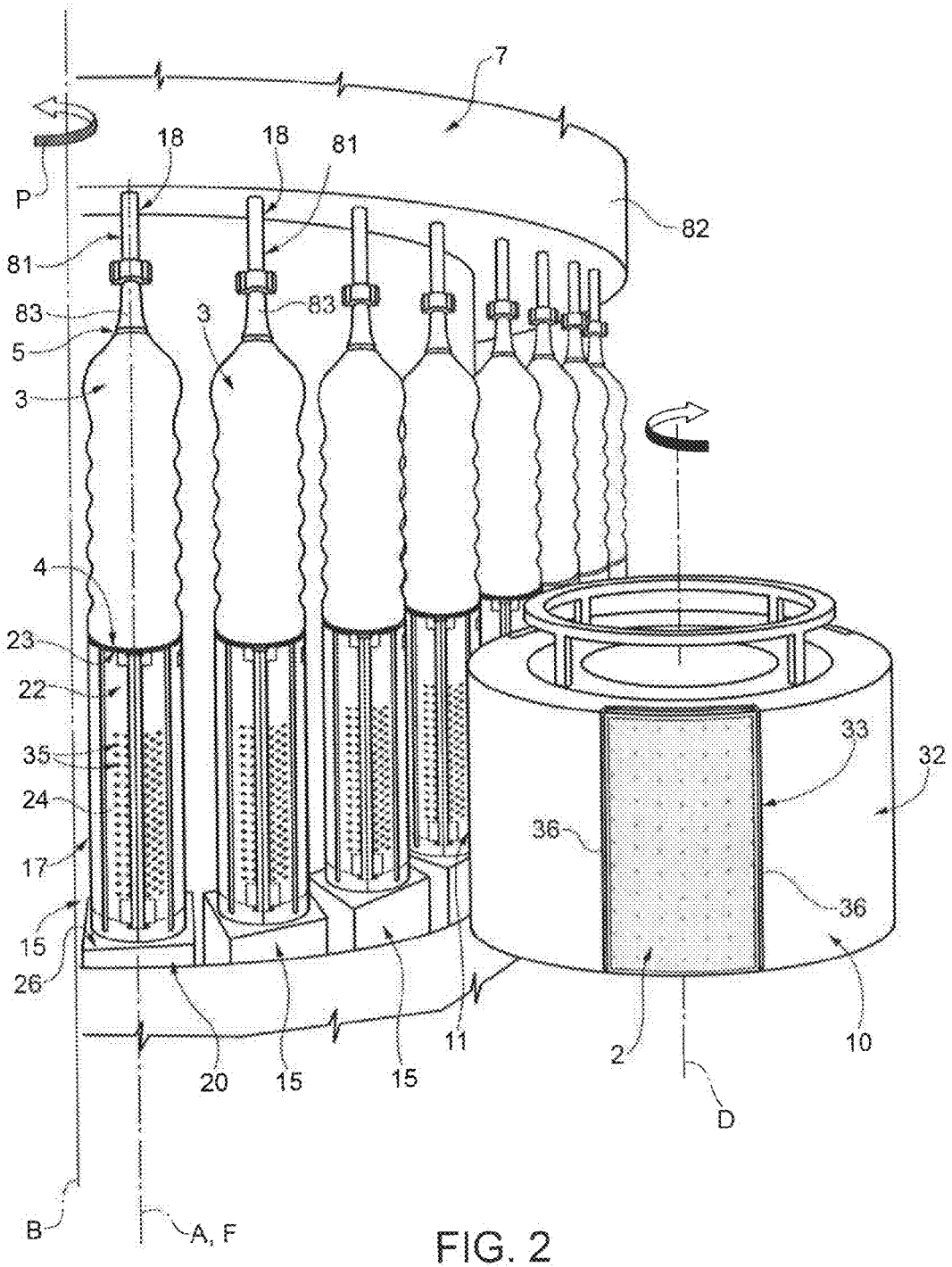
FIGS. 2 and 3 show larger-scale views in perspective of some labelling units of the FIG. 1 labelling machine in proximity of a label transfer station.
Figure 3:
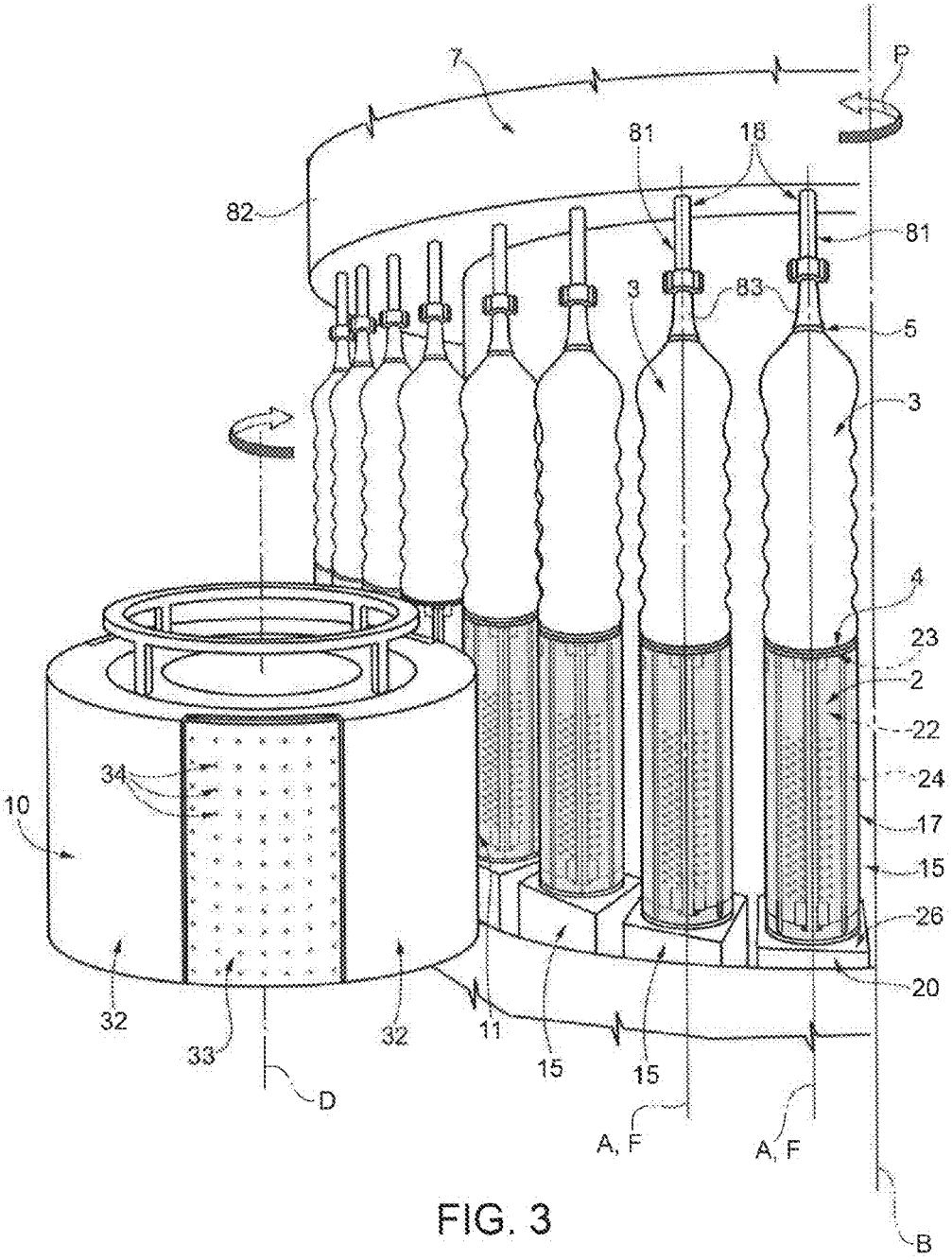

Number 1 in FIG. 1 indicates as a whole a labelling machine for applying labels 2 (FIGS. 2 and 3) to respective articles or more specifically containers, particularly bottles 3, each of which FIGS. 1 to 3) has a given longitudinal axis A, is bonded at the bottom by a bottom wall 4 substantially perpendicular to axis A, and has a top neck 5 substantially coaxial with axis A.

Machine 1 comprises a conveying device that serves to bend and weld labels 2 in a tubular or sleeve configuration (FIG. 3) and to produce insertion of bottles 3 into the so formed tubular labels 2.

In the preferred embodiment as illustrated in the FIGS. 1 to 3, the conveying device comprises a carousel 7, which is mounted to rotate continuously (anticlockwise in FIG. 1) about a respective vertical axis B perpendicular to the FIG. 1 plane.

The carousel 7 receives a succession of unlabelled bottles 3 from an input wheel 8, which cooperates with carousel 7 at a first transfer station 9 and is mounted to rotate continuously about a respective longitudinal axis C parallel to axis B.

The carousel 7 also receives a succession of rectangular or square labels 2 front an input drum 10, which cooperates with carousel 7 at a second transfer station 11 and is mounted to rotate continuously about a respective longitudinal axis D parallel to axes B and C.

The carousel 7 releases a succession of labelled bottles 3 to an output wheel 12, which cooperates with carousel 7 at a third transfer station 13 and is mounted to rotate continuously about a respective longitudinal axis E parallel to axes B, C and D.

Carousel 7 comprises a number of labelling units 15, which, are equally spaced about axis B, are mounted along a peripheral edge of carousel 7, and are moved by the carousel 7 along a circular path P extending about, axis B and through transfer stations 9, 11 and 13.

As shown in FIG. 1, transfer station 11 is arranged, along path P, downstream from transfer station 9 and upstream from transfer station 13.

Figure 4:
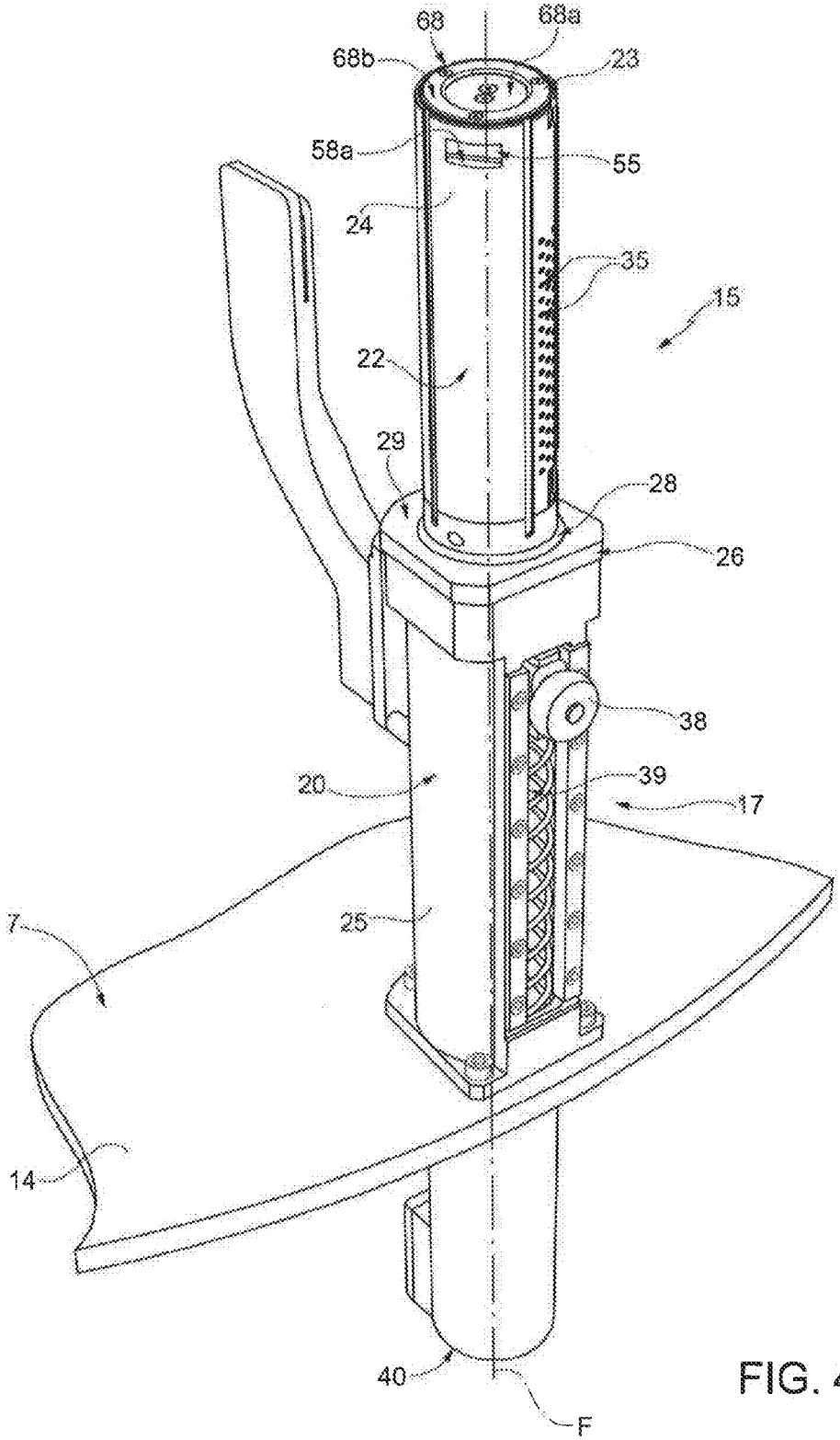
FIG. 4 shows a larger-scale view in perspective, with parts removed for clarity, of a labeling unit according to the present invention.

With reference to FIGS. 2 to 4, labelling units 15 are secured to a horizontal rotary table 14 of carousel 7, have respective axes F parallel to axes B, C, D, E and extend coaxially through respective holes (not shown) of the rotary table 14 and on both sides of such table.

Each labelling unit 15 is adapted to receive a relative bottle 3 from input wheel 8 in a vertical position, i.e. coaxially with the relative axis F, and to hold said bottle 3 in such position along path P from transfer station 9 to transfer station 13.

Labelling units 13 being identical to each other, only one is described below for the sake of simplicity and clarity; it is clear that the features described hereafter are common to ail labelling units 15.

In particular, labelling unit 15 comprises, above rotary table 14 of carousel 7, a supporting assembly 17 adapted to support bottom wall 4 of a respective bottle 3 and an upper retainer 18 adapted to cooperate with top neck 5 of such bottle 3.

More specifically, supporting assembly 17 comprises:

a hollow supporting mount 20 of axis F, which is secured to a top surface of rotary table 14 around the relative hole thereof; and a hollow receiving member 22, engaging the supporting mount 20 in sliding and rotating manner with respect to axis F, and adapted to carry coaxially a bottle 3 on its top end 23 and a label 2 on the outer surface of its lateral wall 24.

In greater details, supporting mount 20 comprises a vertical tubular body 25 and a top platform 26 secured to the body 25 by releasable fastening means (for instance known from WO 2011/104732 and not shown) and provided with a central hole 28, through which receiving member 22 may be axially displaced; in practice, top platform 26 defines a horizontal surface 29, along which bottles 3 are transferred onto and from labelling unit 15.

Receiving member 22 can be moved along axis F between a fully retracted position within the relative supporting mount 20 (not shown) and a raised position (FIGS. 2, 3 and 4).

In the fully retracted position, receiving member 22 is completely housed within body 25 of the respective supporting mount 20 so that top end 23 is flush with surface 29 of top platform 26.

In the raised position, receiving member 22 protrudes from surface 29 and is adapted to receive, on the outer surface of its lateral wall 24, a respective label 2 from input drum 10.

More specifically, labels 2 are cut in a know manner from a web 30 (FIG. 1) by a cutting device 31 (only schematically shown in FIG. 1) and fed to input drum 10 to be then transferred to the respective receiving members 22 in the raised position.

As shown in FIGS. 2 and 3, the cut labels 2 are retained on a lateral surface 32 of input drum 10 by suction; in fact, the lateral surface 32 of input drum 10 is divided into a given number, three in the embodiment shown, of suction regions 33, which are equally spaced about axis D, are each provided with a plurality of through holes 34 connected to a pneumatic suction device (known per se and not shown) and are adapted to cooperate with respective labels 2.

In a completely analogous manner (FIGS. 2-5), lateral wall 24 of receiving member 22 is provided with a plurality of through holes 35, in turn connected to a pneumatic suction device (known per se and not shown) so as to retain the respective label 2 on its outer surface by suction.

At transfer station 11, receiving member 22 can be rotated about its axis F in order to produce the complete wrapping of the respective label 2, coming from input drum 10, on the outer surface of its lateral wall 24. In particular, each label 2, fed by input drum 10, is wrapped around the respective receiving member 22 in the raised, position so as to form a tube or sleeve with the opposite vertical edges 36 overlapped one another.

As it appears from above, receiving member 22, during its travel along path P with the other components of labelling unit 15, is subjected to distinct movements in different operative steps of the labelling machine 1:

displacement along axis F from the fully retracted position to the raised position, after a bottle 3 has been transferred to labelling unit 15;

a rotational movement about axis F to receive a respective label 2 from input drum 10 and to allow bending of such label in the tubular or sleeve configuration; and a displacement from the raised position to the fully retracted position to allow insertion of the bottle 3 within the label 2 welded in the tubular configuration.

The translational displacements along axis F are obtained by cooperation of a fixed cam (known per se and not shown) extending along path P and a cam follower 38 coupled to receiving member 22 and protruding radially outwards from a vertical through slot 39 of body 25 of supporting mount 20, i.e. from a slot extending parallel to axis F.

The rotational movement is instead obtained by means of an actuator assembly 40 (FIG. 4) arranged underneath rotary table 14 and secured to a bottom surface of the rotary table 14 itself.

Actuator assembly 40 comprises a driving shaft 41 (FIGS. 5, 6 and 7) extending coaxially through body 25 of supporting mount 20 and coaxially coupled to receiving member 22.

Figure 5:
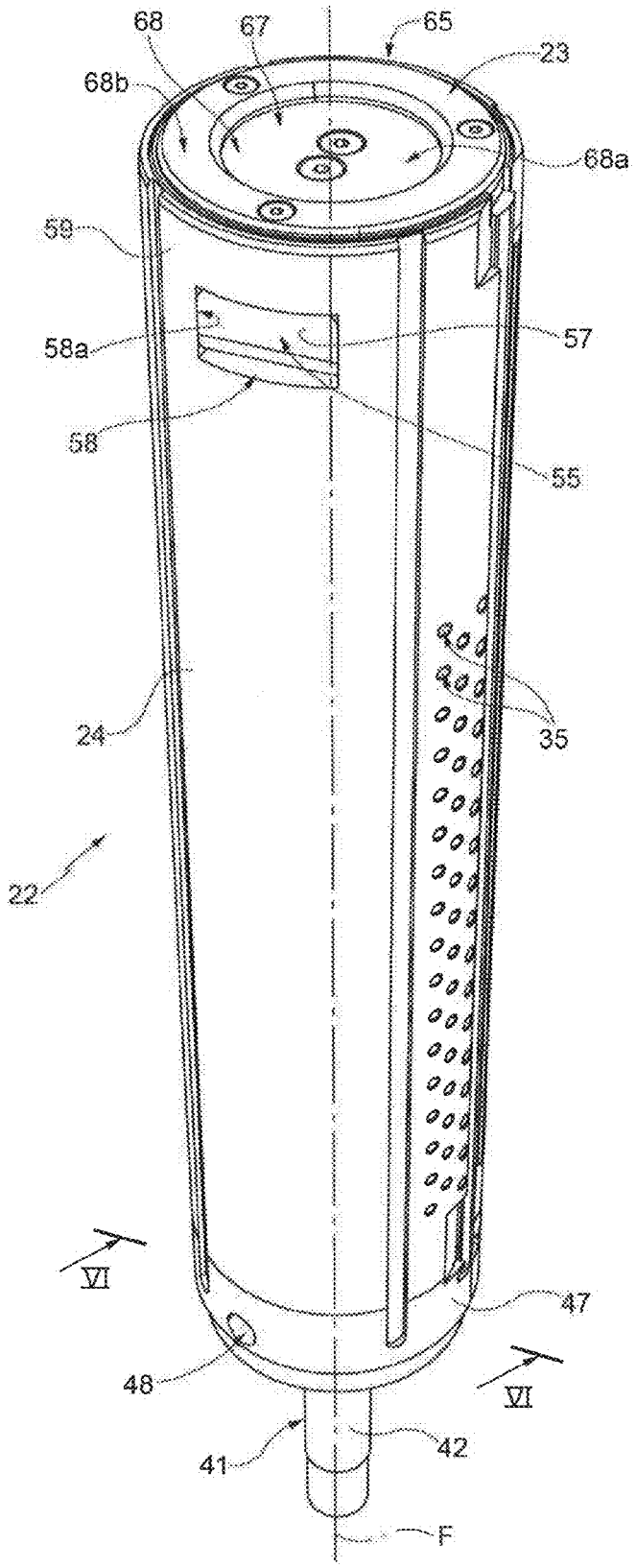
FIG. 5 shows a larger-scale view in perspective of a receiving member of the FIG. 4 labelling unit.
Figure 6:
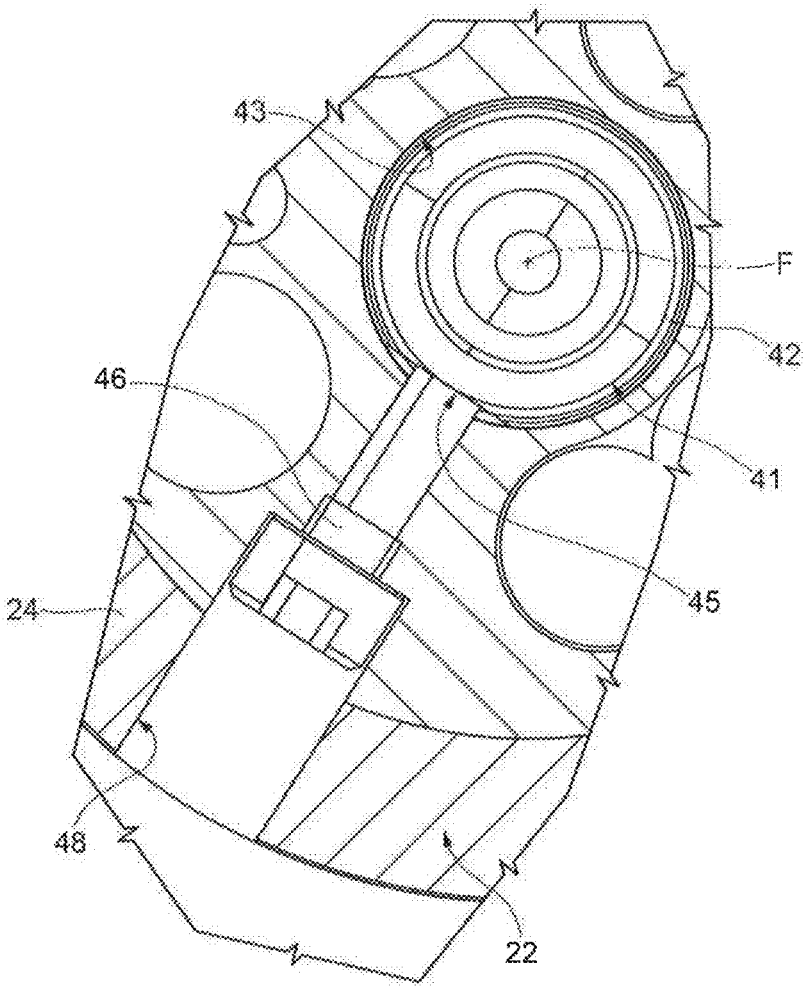
FIG. 6 shows a larger-scale section along line VI-VI of FIG. 5.
Figure 7:
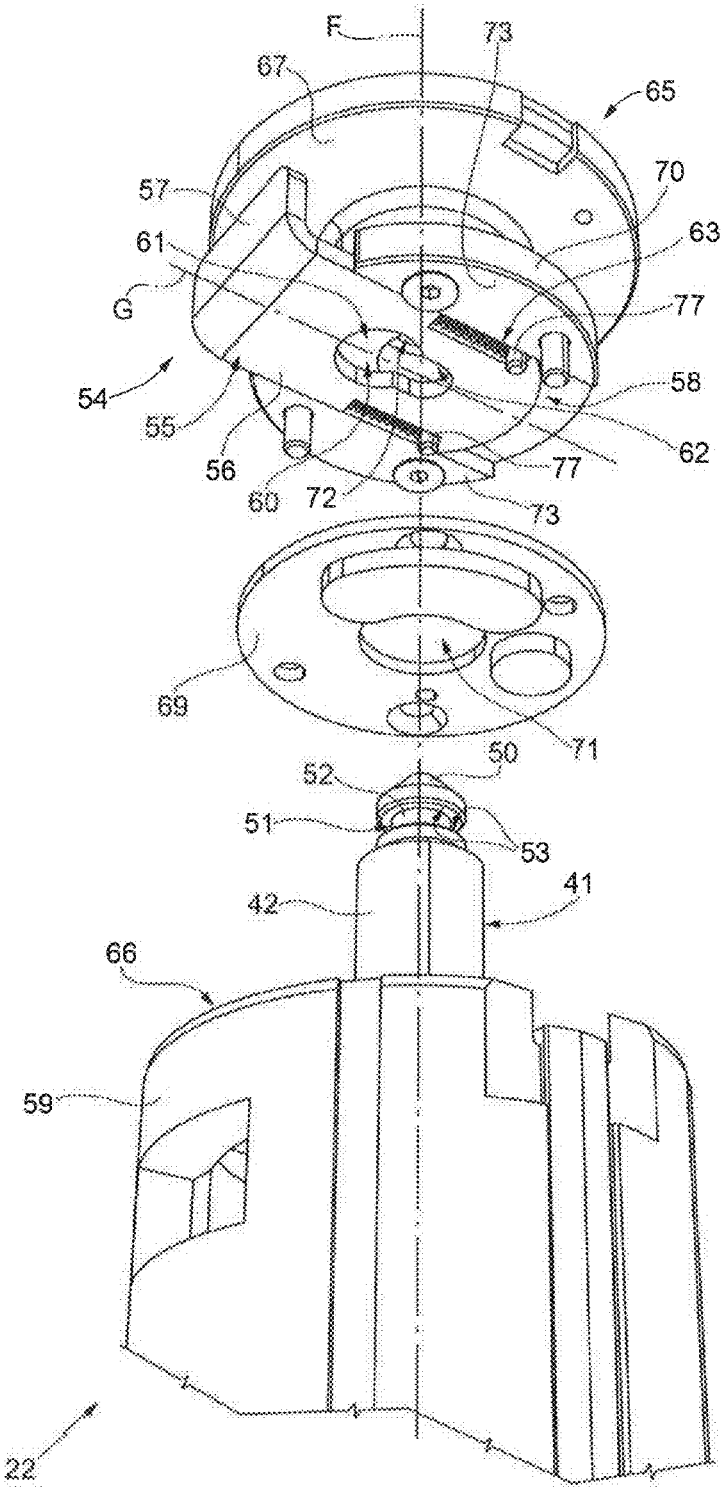
FIG. 7 shows an exploded larger-scale view in perspective of a top portion of the FIG. 5 receiving member.

As visible in FIGS. 5, 6 and 7, driving shaft 41 has a transmission portion 42, which extends through a central hole 43 of receiving member 22 and is coupled to the receiving member 22 to rotate about axis F.

In particular, transmission portion 42 of driving shaft 41 has a flattened longitudinal band 45 cooperating in use with a transversal pin 46 carried by a bottom portion 47 of receiving member 22 in order to couple rotationally this latter member with the driving shaft 41.

More specifically, pin 46 engages a hole 48 formed in bottom portion 47 of receiving member 22 and extending radially with respect to axis F. Pin 46 has one end contacting in use longitudinal band 45 of transmission portion 42 of driving shaft 41; in this way, the rotational movements of driving shaft 41 about axis F are transmitted to receiving member 22 through pin 46.

As shown in FIG. 6, transmission portion 42 of driving shaft 41 has a conical free end 50 and is provided with an annular groove 51, which is adjacent to end 50 and defines a reduced-section portion 52 of the driving shaft 41, whose function will be clarified later on.

In particular, reduced-section portion 52 forms with the adjacent parts of driving shaft 41 respective facing annular shoulders 53.

With reference to FIGS. 4, 5 and 7, labelling unit 15 further comprises releasable fastening means 54 to connect driving shaft 41 to receiving member 22 in a predetermined axial position with respect to axis F; in other words, fastening means 54 are adapted to lock axially receiving member 22 on transmission portion 42 of driving shaft 41.

Releasable fastening means 54 advantageously comprise a spline element 55 carried by receiving member 22 and movable along a radial direction G with respect, to axis F between a retaining position (FIGS. 5, 7 and 8), in which the spline element 55 is coupled with reduced-section portion 52 of driving shaft 41, and a release position, in which the spline element 55 is released from driving shaft 41 and allows extraction of receiving member 22 from the driving shaft 41 and supporting mount 20 along axis F.

In particular, spline element 55 (FIGS. 7 and 8) integrally comprises a plate-shaped main portion 56, extending orthogonally to axis F, and a raised or bent end portion 57, extending orthogonally to main portion 56 and joined to the latter by a curved connecting portion.

Spline element 55 slidably engages a radial seat 58 formed in a top portion 59 of receiving member 22 and which communicates with the outside through a window 58*a* formed in lateral wall 24; end portion 57 of spline element 55 engages window 58*a* so that it can be operated by the user from the outside of receiving member 22 to move spline element 55 from the retaining position to the release position.

Main portion 55 of spline element 55 comprises a keyway 60 engaged by transmission portion 42 of driving shaft 41; keyway 60 is formed by a first opening 61, adapted to receive driving shaft 41 in a loosely manner along axis F in the release position of spline element 55, and a second opening 62, communicating with the opening 61 and configured to mate with reduced-section portion 52 of driving shaft 41 in the retaining position of spline element 55 so as to prevent any displacement of receiving member 22 with respect to the driving shaft 41 along axis F.

In particular, opening 61 is defined by a hole having the same diameter as hole 43 of receiving member 22; opening 62 is instead defined by a slot extending laterally from opening 61 and having a smaller size than the diameter of the opening 61 in a direction orthogonal to direction G and axis F as well as parallel to main portion 56.

In the retaining position of spline element 55, reduced-section portion 52 of driving shaft 41 engages opening 62 of keyway 60 of spline element 55 so that the edges of the slot portion 62 define respective abutments for shoulders 53 of driving shaft 41.

In the release position of spline element 55, opening 61 of keyway 60 is arranged coaxially to hole 43 of receiving member 22 so as to allow extraction of the receiving member 22 from driving shaft 41 and supporting mount 20 along axis F.

As it will be explained in greater details hereafter, spline element 55 is normally set in the retaining position by the action of spring means 63 and can be moved to the release position against the thrust exerted by such spring means.

In the example shown in FIGS. 4, 5, 7 and 8, seat 58 is formed in a closure assembly 65 fixed into a top cavity 66 of receiving member 22 and defining too end 23 of the receiving member 22 itself.

In particular, top cavity 66 is cup-shaped and communicates at the bottom with axial hole 43; more specifically, top cavity 66 is delimited, laterally by a top end portion of lateral wall 24 and inferiorly by a bottom surface (not visible), through which hole 43 extends.

Closure assembly 65 comprises a cover member 67, defining on its outer side a top surface 68 on which a respective bottle 3 rests in use, a lower plate 69, abutting against the bottom surface of top cavity 66, and an intermediate plate 70 sandwiched between cover member 67 and lower plate 69.

In particular, top surface 68 has a central flat portion 68*a* cooperating in use with bottom wall 4 of the respective bottle 3 and a raised annular edge 68*b* cooperating laterally with the bottle 3 to maintain it in a centered position on receiving member 22 with respect to axis F.

Figure 8:
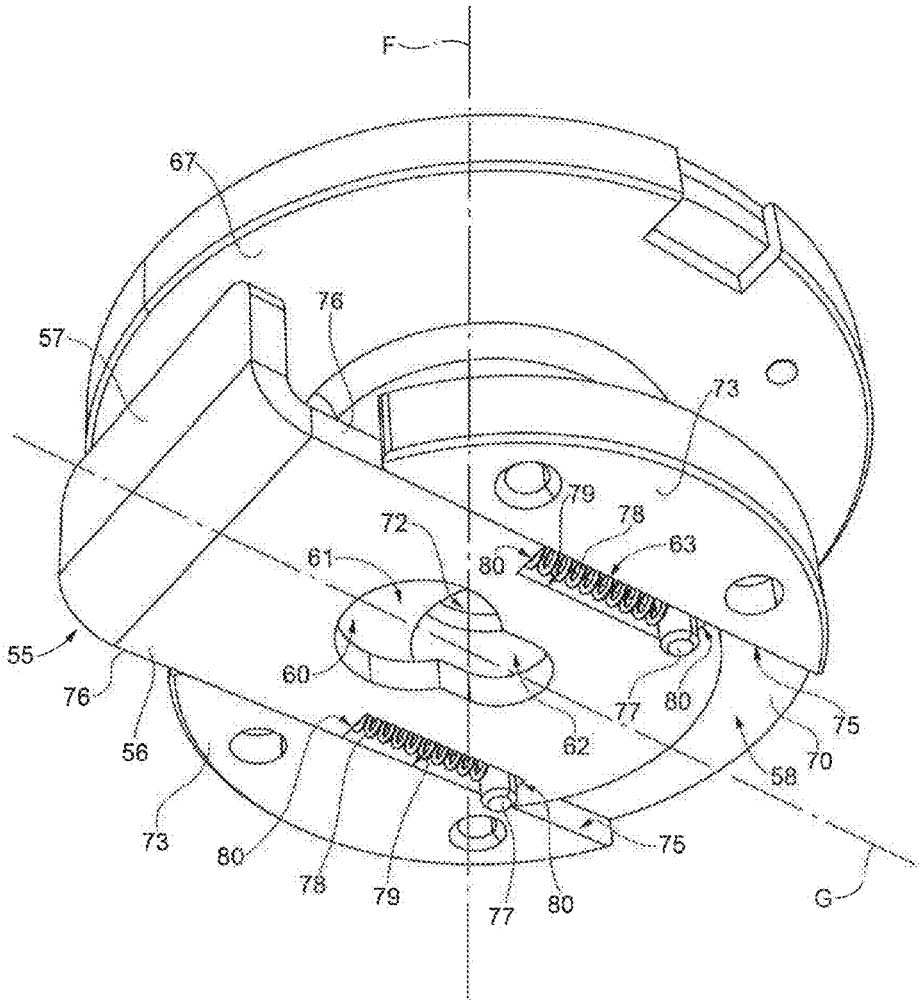
FIG. 8 shows a larger-scale view in perspective of a detail of FIG. 6.

With particular reference to FIGS. 7 and 8, lower plate 69 is substantially disk-shaped and has a central through hole 71 coaxial with hole 43.

Lower plate 69 and intermediate plate 70 together delimit seat 58, in which spline element 55 in use slides.

Intermediate plate 70 is substantially disk-shaped and has a central seat 72 coaxial with axis F and receiving conical end 50 of driving shaft 41.

Intermediate plate 70 further comprises two raised sides 73, protruding towards lower plate 69 and delimiting laterally seat 58, along which spline element 55 slides. In particular, raised sides 73 are delimited by respective facing flat guide surfaces 75 parallel to direction G and axis F; opposite sides 76 or spline element 55 slide in use along respective guide surfaces 75.

Intermediate plate 70 also comprises two protruding pins 77 parallel to axis F, located adjacent to the respective guide surfaces 75 and defining in use respective abutments for spline element 55 to prevent its complete extraction from seat 58 under the thrust of spring means 63.

With particular reference to FIGS. 7 and 8, spring means 63 comprise two helical springs 78 housed within respective step-shaped depressions 79 of opposite sides 76 of spline element 55.

In particular, each depression 79 defines respective facing shoulders 80 orthogonal to direction G; one of the shoulders 80 of each depression 79 cooperates with a respective pin 77 to prevent complete extraction of spline element 55 from seat 58 along direction G; the other shoulder 80 of each depression 79 cooperates with one end of the respective spring 78, whose opposite end is instead in contact with the adjacent pin 77. In practice, each spring 78 is housed in a respective depression 79 of spline element 55 and is interposed between one shoulder 80 and the respective pin 77; as visible in FIGS. 7 and 8, each spring 78 is in use housed in a seat delimited, on one side by the respective depression 79 of spline element 55, and, on the opposite side, by the respective guide surface 75 of intermediate plate 70.

As visible in FIGS. 2 and 3, bottles 3 are hold on the respective labelling units 15 by the interaction of bottom supporting assemblies 17 with the respective upper retainers 18; more specifically, the retainer 18, corresponding to the described supporting assembly 17, comprises, in a known manner, a cylindrical movable member 81, which protrudes vertically from an upper rotary portion 82 of carousel 7, can be displaced along the respective axis F and has a bell-shaped free end portion 83 adapted to cooperate with the top neck 5 of the bottle 3 carried by such supporting assembly 17.

More specifically, the displacements of each movable member 81 are controlled in a known manner so as to maintain the same distance between its end portion 83 and the corresponding top end 23, during the movement of the respective labelling unit 15 along the portion of path P from transfer station 9 to transfer station 13, and to increase such distance at transfer stations 9, 13 and during the portion of path P from station 13 to station 9. In this way, bottles 3 are securely hold in their vertical positions during the travel from station 9 to station 13 and are free to be transferred at such stations 9 and 13 from input wheel 6 and to output wheel 12, respectively.

With reference to FIG. 1, machine 1 further comprises a plurality of welding devices 85, each of which arranged in front of, and in a radially inner position than, the respective labelling unit 15 and adapted to cooperate, in a known manner, with the label 2 wrapped around the corresponding receiving member 22 for welding the overlapped edges 36 and to produce a tabular configuration of such label.

After completion of the welding of a tubular label 2, the downward movement of the respective receiving member 22 towards the fully retracted position within the respective supporting mount 20 produces the insertion of the bottle 3 inside said tubular label. The so formed labeled bottle 3 is then fed to a shrinking tunnel (known per se and not shown), where shrinking and adhesion of the label 2 to the external surface of the bottle 3 occurs.

Operation of machine 1 will now be described with reference to the labelling of one bottle 3, and therefore to one labelling unit 15, and as of the instant in which the receiving member 22 of such labelling unit 15 is in the raised position and supports the unlabelled bottle 3 received from input wheel 8.

In this condition, the bottle 3, which rests on top surface 68 of receiving member 22, is hold in the vertical position by the combined action of the receiving member 22 and the respective upper retainer 18.

At transfer station 11, input drum 10 reaches an angular position around axis D adapted to put the label 2 into contact with the receiving member 22 passing through such station; in this condition, a pure rotational movement of receiving member 22 around axis F is required to produce complete wrapping of the label 2 in a known manner around such receiving member 22 (FIG. 3).

This rotational movement is obtained by activating actuator assembly 40 so as to rotate driving shaft 41 about axis F; thanks to the cooperation of flattened longitudinal band 45 of driving shaft 41 with pin 46, receiving member 22 rotates together with the driving shaft 41.

At the end of rotation of receiving member 22 about axis F, the label 2 reaches a tubular configuration with the opposite vertical edges 36 overlapped one another.

At this point, the label 2 is ready to be welded along the edges 36 by activation of the welding device 85.

During the last part of path P, the receiving member 22 is moved back to the fully retracted position within the respective supporting mount 20, so as to produce the insertion of the bottle 3 inside the so formed tubular label 2.

A heat-shrinking step (not shown) can be then performed on the bottles 3 exiting from carousel 7 to obtain shrinking and adhesion of the label 2 to the bottle external surface.

In the case in which it is necessary to change format of the bottles 3 to be processed by machine 1, for instance to pass to a new bottle having a bottom diameter different from the previously processed one, top platforms 26 and receiving members 22 have to be replaced by new ones having suitable sizes; in particular, the new receiving member 22 should have a diameter related to the bottle diameter to be carried on its top surface 68 and the new top platform 26 should have a diameter of hole 28 suitable to be engaged by the new receiving member 22 in a sliding and rotating manner.

Thanks to the new configuration of fastening means 54, removal of each receiving member 22 from the respective supporting mount 20 simply requires the following quick steps:

a) pushing spline element 55 further inwards within seat 58 into the release position so as to allow free axial relative movement of the receiving member 22 with respect to driving shaft 41; and b) extracting the receiving member 22 with respect to the driving shaft 41 along axis F.

During the step a), opening 61 of keyway 60 is placed coaxial to hole 43 so as to uncouple spline element 55 from reduced-section portion 52 of driving shaft 41.

During the step b), pin 46 carried by the receiving member 22 slides along flattened longitudinal band 45 of driving shaft 41.

The connection of each new receiving member 22 to the respective supporting mount 20 can be obtained by repeating step a) and by axially mounting the new receiving member 22 onto the driving shaft 41. At the end of these operations, once released by the user, the spline element 55 goes back to the retaining position under the thrust of springs 78; in this position, opening 62 of keyway 60 is engaged by reduced-section portion 52 of driving shaft 41.

The advantages of labelling unit 15 according to the present invention will be clear from the above description.

In particular, as previously explained, the new solution of fastening means 54 permits a very quick and easy change of the receiving members 22, without requiring to use specially provided tools, such as screwdrivers. This also means to reduce the machine stop time for performing the necessary replacements, so permitting a considerable saving.

Clearly, changes may be made to labelling unit 15 as described and illustrated herein without, however, departing from the scope of protection as defined in the accompanying claims.

In particular, each receiving member 22 may be also non-cylindrical, i.e. it may have an oval cross-section in a plane orthogonal to its axis. In this case, each label 2 would be welded in an endless or sleeve configuration around the lateral surface of the non-cylindrical receiving member.

The invention claimed is:

1. A labelling unit for applying a label onto an article; said labelling unit comprising:

support means;

a receiving member adapted to carry said article on a top end and to receive said label on a lateral surface, and supported by said support means in a translating and rotating manner with respect to a given axis;

driving means selectively activated to rotate said receiving member about said axis and including a driving shaft carried by said support means in a rotating manner about said axis and engaging an axial hole of said receiving member; and releasable fastening means to connect said driving shaft to said receiving member in a predetermined axial position;

wherein said releasable fastening means comprise a spline element movable transversely to said axis between a retaining position, in which said spline element locks axially said receiving member onto said driving shaft, and a release position, in which said spline element allows extraction of said receiving member from said driving shaft and said support means along said axis.

2. The labelling unit as claimed in claim 1, wherein said spline element is carried by said receiving member and is released from said driving shaft in said release position.

3. The labelling unit as claimed in claim 1, wherein said spline element is movable along a radial direction with respect to said axis.

4. The labelling unit as claimed in claim 1, wherein said spline element is movable through a radial seat of said receiving member, communicating with the outside through a window of said lateral wall.

5. The labelling unit as claimed in claim 1, wherein said driving shaft has a reduced-section portion, and wherein said spline element has a keyway comprising:

a first opening, adapted to receive said driving shaft in a loosely manner along said axis in the release position of the spline element; and a second opening, communicating with said first opening and configured to mate with said reduced-section portion of said driving shaft in the retaining position of the spline element so as to prevent any displacement of said receiving member with respect to the driving shaft along said axis.

6. The labelling unit as claimed in claim 5, wherein said first opening comprises a hole having the same diameter as said axial hole of said receiving member, and wherein said second opening comprises a slot extending laterally from said first opening and having a smaller size than the diameter of the first opening in a direction orthogonal to said direction and said axis.

7. The labelling unit as claimed in claim 1, wherein said spline element is loaded by spring means towards said retaining position.

8. The labelling unit as claimed in claim 1, further comprising transmission means distinct from said spline element and adapted to couple rotationally said receiving member with said driving shaft.

9. The labelling unit as claimed in claim 8, wherein said transmission means comprise a flattened longitudinal band of said driving shaft cooperating in use with a transversal pin carried by said receiving member.

10. The labelling unit as claimed in claim 1, wherein said receiving member is movable along said axis between:

a raised position, in which said receiving member axially protrudes from said support means, carries said article on a top end and is adapted to receive said label wrapped around its a lateral surface; and a retracted position, in which said receiving member is housed within said support means so as to permit insertion of said article into said label in an endless or sleeve configuration.

* * * * *